United States Patent [19]

Roila

[11] Patent Number: 4,934,533

[45] Date of Patent: Jun. 19, 1990

[54] PROTECTIVE PACKAGING FOR EGGS

[75] Inventor: Patrizio Roila, Santa Sabina, Italy

[73] Assignee: Europoligrafico S.p.A., Perugia, Italy

[21] Appl. No.: 241,743

[22] Filed: Sep. 8, 1988

[30] Foreign Application Priority Data

Sep. 8, 1987 [IT] Italy ..... 48361 A/87

[51] Int. Cl.[5] ..... B65D 85/32

[52] U.S. Cl. ..... 206/521.7; 106/521.8

[58] Field of Search ..... 229/2.5 EC; 206/521.6, 206/521.7, 521.8

[56] References Cited

U.S. PATENT DOCUMENTS

| | | | |
|---|---|---|---|
| 1,115,449 | 10/1914 | Morgan | 206/521.7 |
| 1,763,588 | 6/1930 | Johnson . | |
| 1,853,746 | 4/1932 | Robin . | |
| 1,940,292 | 12/1933 | Bueschel | 206/521.7 |
| 3,642,190 | 2/1972 | Glaser | 229/151 |

FOREIGN PATENT DOCUMENTS

| | | | |
|---|---|---|---|
| 206060 | 2/1955 | Australia | 206/521.7 |
| 254038 | 5/1967 | Austria | 206/521.7 |
| 711118 | 6/1965 | Canada | 206/521.8 |
| 594451 | 6/1959 | Italy | 206/521.7 |
| 473461 | 10/1937 | United Kingdom | 229/2.5 EC |
| 973631 | 10/1964 | United Kingdom . | |
| 996675 | 6/1965 | United Kingdom | 206/521.8 |

*Primary Examiner*—Gary Elkins

*Attorney, Agent, or Firm*—Browdy and Neimark

[57] ABSTRACT

A protective packaging for eggs comprising a containing part and a covering part, said parts being superimposable and, interchangeable, including a top wall, a bottom wall and two opposed lateral walls, and being obtained from flat, single piece punched members that are distinct and separated or hinge-connected and being, provided with fastening members in the superimposed condition; each of which has a predetermined number of complementary half-housings for eggs, and which in the superimposed condition of said containing and covering parts constitute complete housing suitable for supporting eggs therein in a shock-free manner and in a spaced relationship with respect to said top, bottom and lateral walls.

7 Claims, 6 Drawing Sheets

FIG. 3
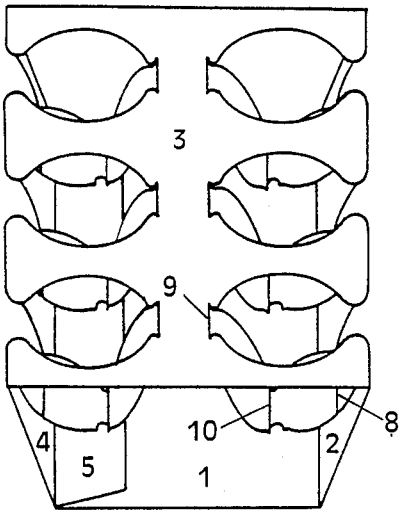
FIG. 4
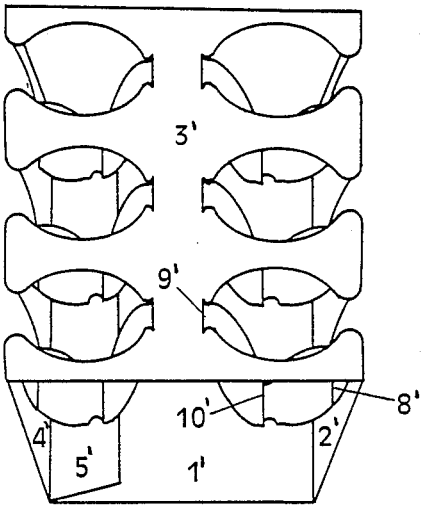
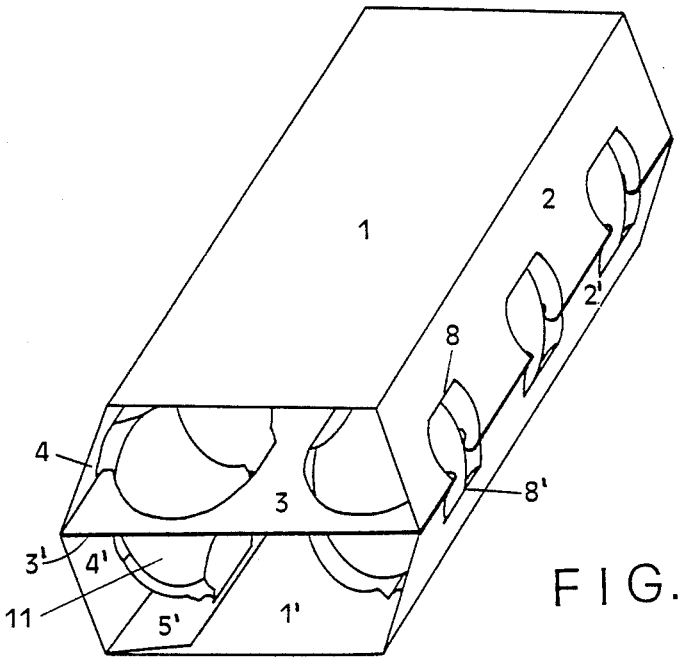
FIG. 5

FIG. 8
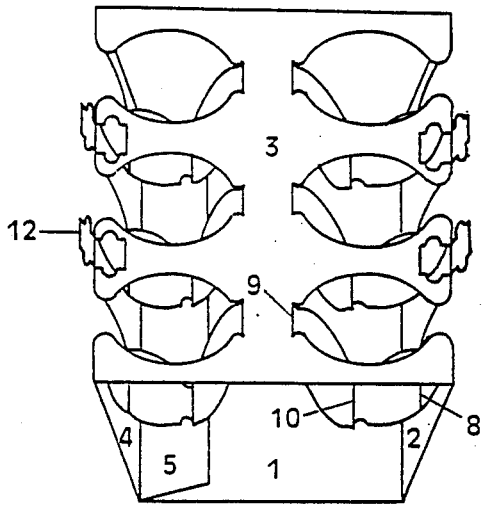
FIG. 9
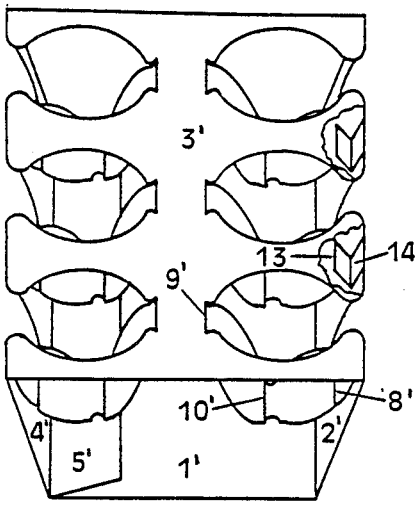
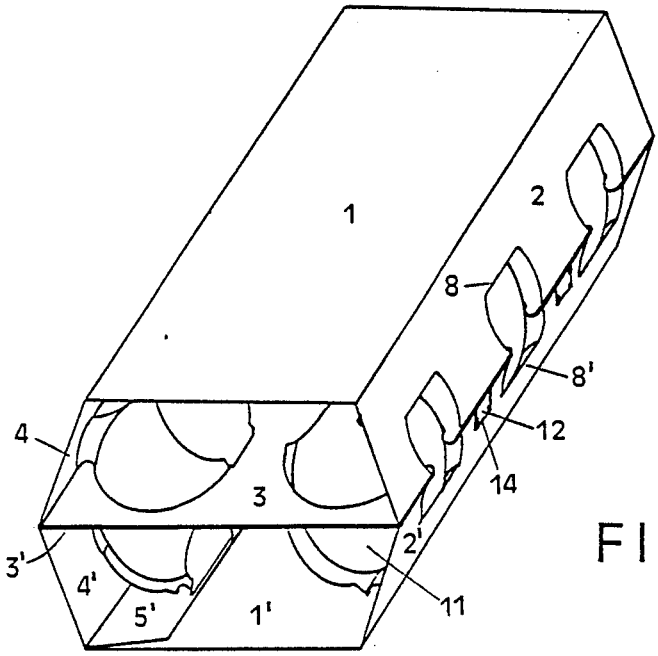
FIG. 10

FIG.13
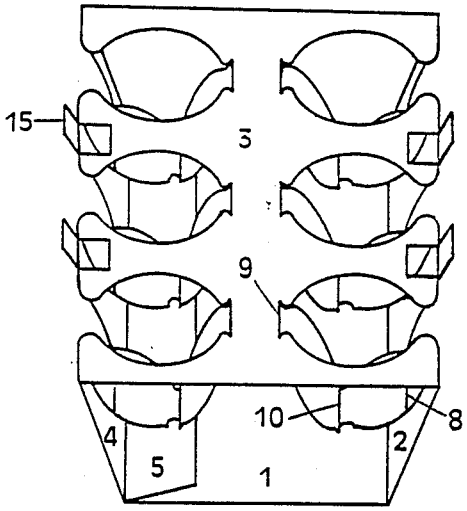
FIG.14
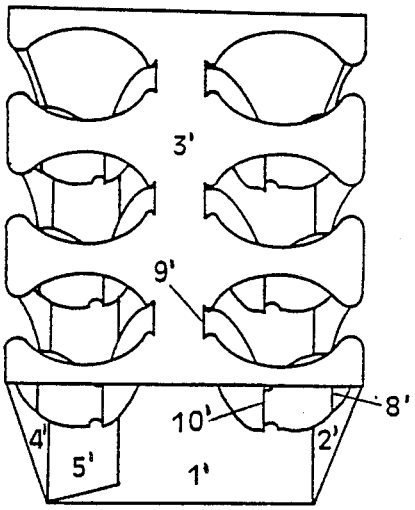
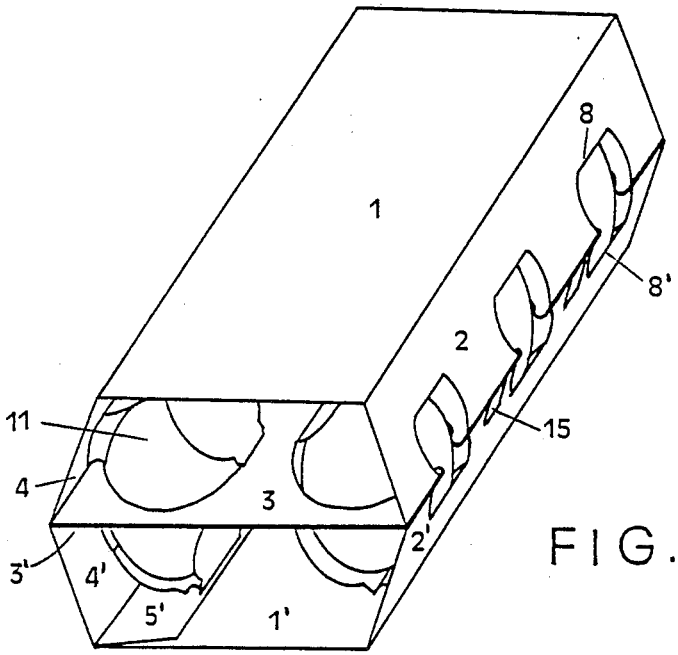
FIG.15

PROTECTIVE PACKAGING FOR EGGS

FIELD OF THE INVENTION

The present invention refers to a packaging for eggs suitable for the protection of said products from shocks during transport and distribution in order to keep them whole.

BACKGROUND OF THE INVENTION

At the present time several devices are known which are intended for the protection of eggs, generally comprising containers made of plastic or suitably treated cardboard forming two superposable half-shells in which respective cavities are formed, each having substantially the shape of an half egg in a transversal direction, so as to form single complete compartments for the eggs on superimposition said two half-shells, in order to prevent the breakage of said eggs as consequence of shocks and the like.

On the other hand, the conventional devices for the protection of eggs as above mentioned, apart from their effectiveness, are not without inconveniences deriving in particular from the fact that an appreciable waste of material occurs, and an appreciable outlay of money for the construction of the forming molds is necessary, to which further ecological inconveniences are to be added due to the difficulty of when they are no longer needed.

SUMMARY OF THE INVENTION

The present invention provides a protective packaging for eggs, obtained from single-piece punched members of cardboard or the like, comprising a structure which is extremely simple, cheap, practical, and functional for optimally containing eggs in a shock-proof manner to avoid breakage caused by shocks or the like and to obviate the above-mentioned drawbacks.

To the above mentioned advantages of the protective packaging for eggs according to the present invention must be added the advantage that it is suitable to be easily and rapidly assembled into a three-dimensional shape by means of mechanical devices starting from suitably arranged single-piece flat punched members.

The present invention will be better understood by referring to the description of preferred embodiments, given as in the non-limiting examples, by reference to the drawings: Description of the Invention

BRIEF DESCRIPTION OF THE DRAWINGS

FIGS. 3 and 4 show perspective views from one end of the covering part and of the containing part, respectively, of the packaging assembled in a three-dimensional shape, starting from the punched members of FIG. 1 and FIG. 2, respectively;

FIG. 5 is a perspective view of the first embodiment of the packaging in question in its operative condition formed by the superimposition and fixing of the covering part of FIG. 3 on the containing part of FIG. 4;

FIGS. 8 and 9 are perspective views from one end of the covering part and the containing part, respectively, of the packaging, assembled in a three-dimensional form starting from the punched members of FIG. 6 and FIG. 7, respectively;

FIG. 10 shows a perspective view of the second embodiment of the packaging of the invention in its operative condition formed by the superimposition and fastening of the covering part of FIG. 6 onto the containing part of FIG. 7;

FIGS. 13 and 14 show perspective views from one end of the covering part and the containing part, respectively, of the packaging assembled in a three-dimensional form starting from the punched members of FIG. 11 and FIG. 12, respectively; and FIG. 15 is a perspective view of the third emdodiment of the packaging in question in its operative condition, formed by the superimposition and fastening of the covering part of FIG. 13 on the containing part of FIG. 14.

DETAILED DESCRIPTION OF THE INVENTION

Figure 1:
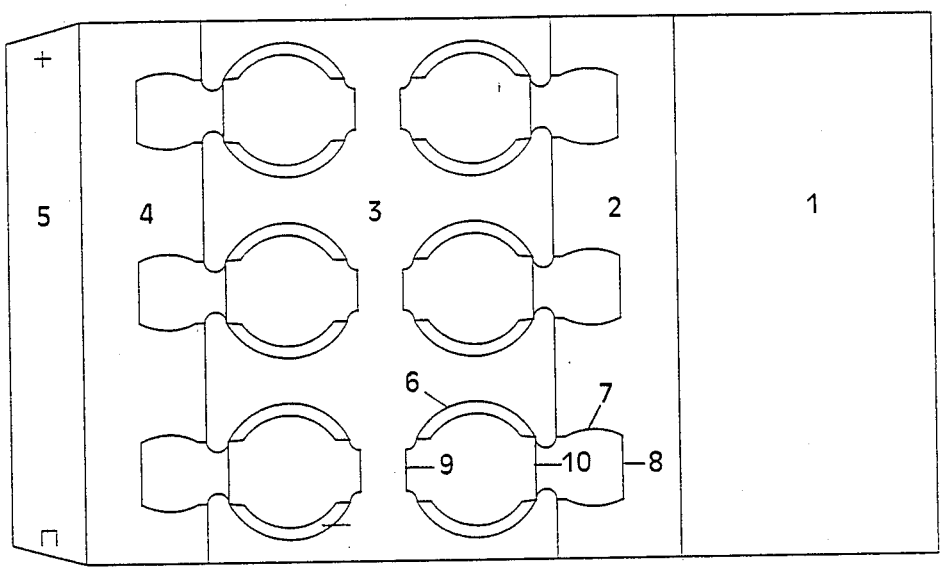
FIGS. 1 and 2 are plan views of single-piece flat punched members for obtaining the covering part and the containing part, respectively, of a first embodiment of the packaging of the invention.
Figure 2:
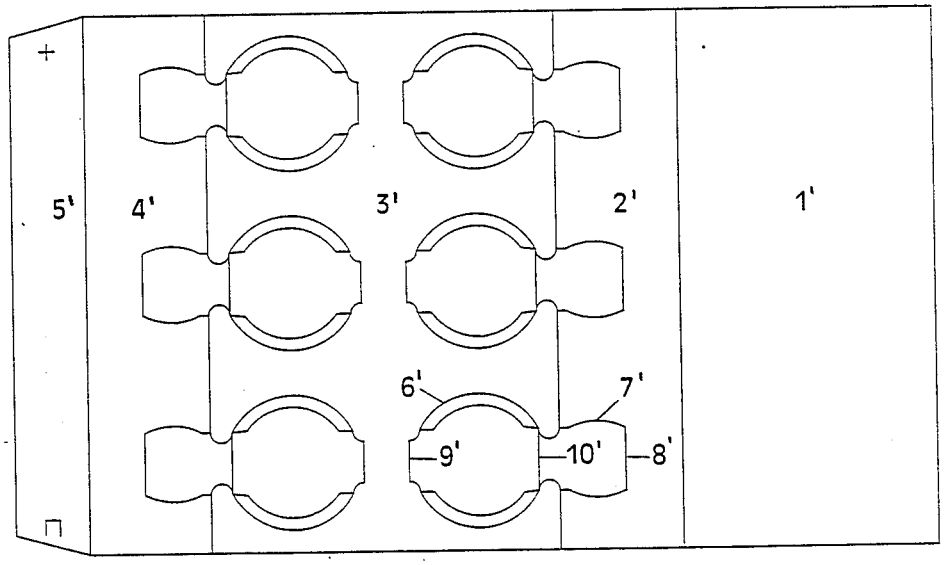

With reference to FIGS. 1 and 2, which show a plan view of the single-piece flat punched members made of cardboard or the like, for obtaining the covering part and the containing part, respectively, of a first embodiment of the present invention, it can be noted that the two above mentioned punched members are exactly alike. As a consequence only one of the punched members will be described in detail, in particular the one shown in FIG. 1, whereas the components of the punched member of FIG. 2 corresponding to those of FIG. 1 with the same reference numerals will be distinguished with an apostrophy, FIG. 1, includes six housings for eggs arranged in two parallel rows of three housings each. In 1 is shown a rectangular panel forming the top wall (the corresponding panel 1' in the punched member of FIG. 2 constituting the bottom wall of the containing part), a long edge of which is connected by means of a crease to a long edge of the rectangular panel 3 forming a first lower wall (the corresponding panel 3' in the punched member of FIG. 2 constituting the upper wall of the containing part), the opposite long edge of which is connected by means of a crease to a long side of a panel 4 of a second lateral wall, the long edge of which is connected by means of a crease to the longest bottom edge of a trapezoidal fastening wing 5.

In the formation of the two parallel rows, each of three half-housings for eggs, sets of cuts are provided in said punched member, the set of cuts for each of said half-housings including two cuts placed symmetrically and not merging, each comprising a first arch shaped portion 6 in the bottom wall panel 3, with the removal of an arched strip of said panel, one end of which is joined to a second curved portion 7 extending transversally into the first lateral wall panel 2 or into the second lateral wall panel 4 according to the position of the half-housing, the corresponding ends of said two symmetrically opposed cuts being connected by first and second creases 8 and 9, respectively, while a third crease 10, parallel to the first and second ones, is formed in an intermediate position in registry with the above mentioned end of said first arch-shaped cut 6.

For the assembly into a three-dimensional form of the covering part and the containing part of the packaging for eggs of the present invention, starting from the respective punched members of FIG. 1 and FIG. 2, the wing 5(5') is bent at a right angle with respect to the panel 4(4') along the connection crease, the panel 3 (3') is folded over the panel 4(4') along the respective connection crease lines, the panel 2(2') is folded with respect to the panel (3'), and the panel 1(1') is folded with respect to the panel 2(2'), bringing the panel 1(1') parallel to the panel 3(3') and making the external face of the wing 5(5') correspond with the corresponding portion of the internal face of panel 1(1'), providing at the same time for their fixing, for example with glue. With said parts in their three-dimensional shape, the portions of the respective punched members included between the pairs of symmetrically opposed cuts 6 and 7 (6' and 7') are made to toggle with a spring action towards the interior, by folding along the creases 8, 9 and 10 (8', 9' and 10'), so as to create in each of said parts half-housings for the eggs each of which is formed by a circular aperture in the panel 3(3') and by an element retaining the egg in a damped way, said element being formed by the respective portions of the punched member toggled towards the interior of said covering and containing parts of the packaging.

The covering part and the containing part of the packaging for eggs according to the present invention for assembly in a three-dimensional form are shown separated in FIGS. 3 and 4, respectively, wherein one can see said half-housings each of which is apt to hold an egg cut transversally in half.

In FIG. 5 the packaging according to the invention is shown in the operative condition with eggs 11 contained in the respective completed housings, obtained from the coupling of corresponding half-housings, formed following the superimposition of the covering part on the containing part and following the fastening, using spots of glue dots, on the lower wall panel 3 of the former and on the top wall panel 3' of the latter.

As can be seen from FIG. 5, the eggs contained in the packaging according to the invention are supported in a spaced relationship both with respect to the panels 2, 4 and 2', 4' of 9 lateral wall, by means of rounded protrusions formed on the external side of said circular apertures in the panels 3 and 3' following the assembly, and also with respect to the panels 1 and 1' of the top wall of the covering part and of the bottom wall of the containing part, respectively, by means of said retaining members which moreover provide for the absorption of the shock forces, without the respective eggs therein contained being affected.

Finally, it should be made clear that the diameter of each of said circular apertures made in the panels 3 and 3' is slightly greater than the diameter of the maximum transverse section of a normal egg so as to allow the use of the packaging with eggs of different sizes.

Figure 6:
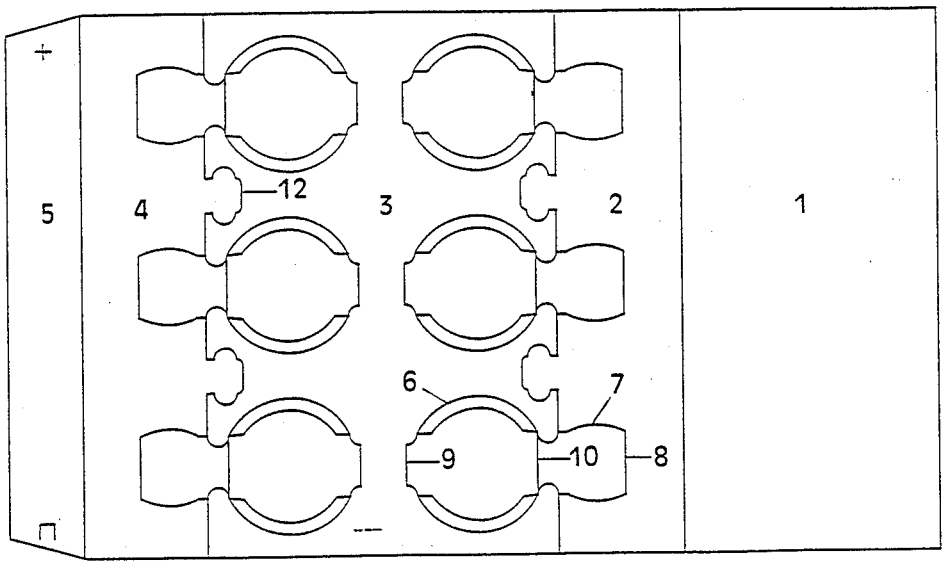
FIGS. 6 and 7 are plan views of single-piece punched members for obtaining the covering part and the containing part, respectively, of a second embodiment of the packaging of the invention.
Figure 7:
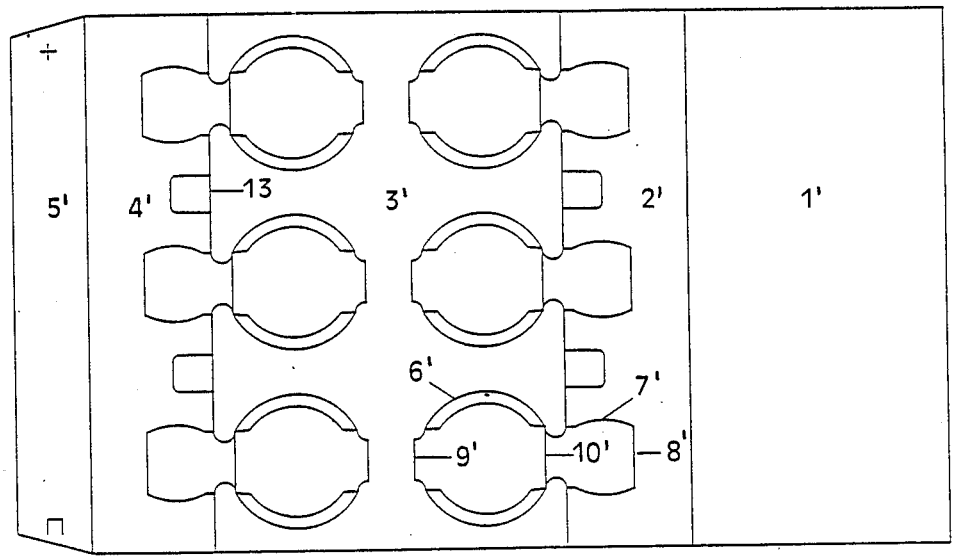

In FIGS. 6 and 7, flat single-piece punched members are shown, wherein the covering part and the containing part, respectively, are obtained according to a second embodiment of the packaging of the invention.

As can be seen upon inspection of said figures the above mentioned punched members are substantially similar to the corresponding punched members of FIGS. 1 and 2 of the former embodiment and they differ from these latter only in the fact that members are provided therein for the fastening of the covering part without recurring to the reciprocal glueing as before described.

Given that, in the punched members being considered; components similar to those of the punched members of FIGS. 1 and 2 will be indicated with the same reference numerals used in the disclosure of the first embodiment of the invention. Attention is drawn to the punched member in FIG. 6, forming the covering part, wherein, in addition to all the components previously disclosed, four tags 12 are obtained, by means of cuts in the lower wall panel 3, said tags being substantially shaped like the point of an arrow, of which two are placed with the respective bases integral with the edge of the panel 2 along the crease connecting it to the panel 3, and the other two, opposed to the first ones, with the respective bases integral with the edge of the panel 4 along the crease connecting it to the panel 3, each of said tags 12 being located in equidistant position between respective arch shaped cuts 6 adjacent to the panel 3.

To each of the tags 12 a respective rectangular wing 13 corresponds, in a similar position on the punched member of FIG. 7 of the containing part, said wings being obtained by means of cuts in the panels 2' and 4' of the lateral wall, and integral with said panels along parallel and opposed base lines with respect to the connection creases of said panels with the panel 3'.

Following the assembly in a three-dimensional form, in the same way as above described, of the cover and containing parts of the packaging, as respectively shown in FIGS. 8 and 9, the tags 12 are again positioned in an upright position while the wings 13 are slightly bent towards the interior, then, on the overlapping of said two parts, (see FIG. 10) the tags 12 are introduced into corresponding holes, shown in 14, formed in the panels 2' and 4' of the lateral wall, following folding of the wings 13, to lock the covering part onto the containing part, said wings 13 pressing elastically over the respective tags 12 to prevent the exit of the latter, thus rendering still more stable the locking of these two parts of the packaging.

Figure 11:
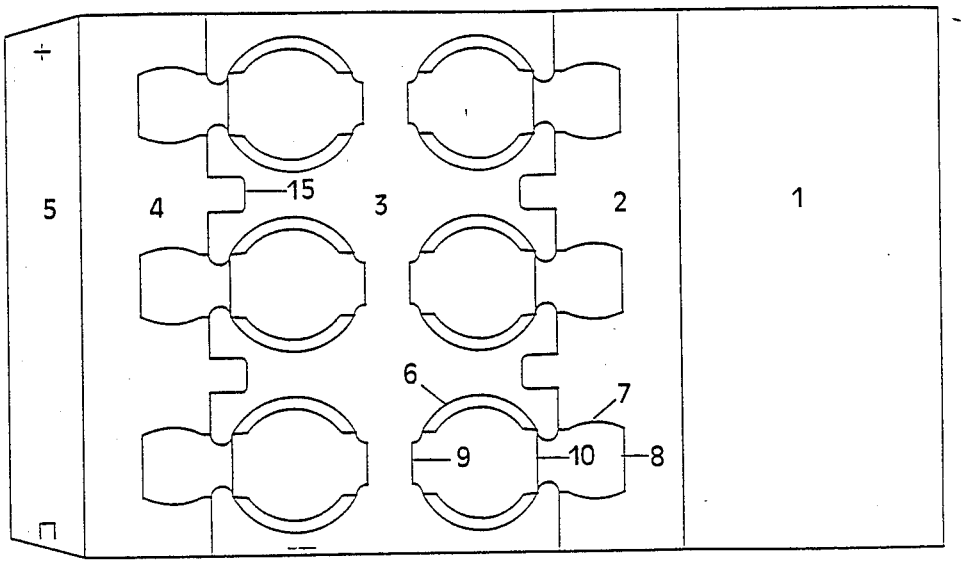
FIGS. 11 and 12 are plan views of flat, single-piece punched members for obtaining the covering part and the containing part, respectively, of a third embodiment of the packaging of the invention.
Figure 12:
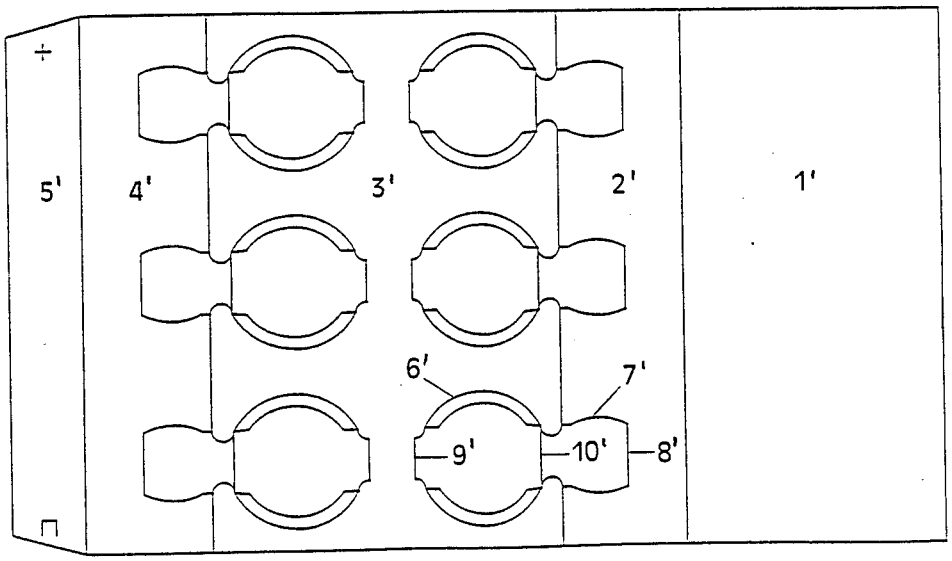

Finally, with reference to FIGS. 11 and 12, the single-piece flat punched members of the cover and containing part, respectively, of a third embodiment of the packaging are shown.

While the punched member of FIG. 12 relating to the containing part is exactly the same as the punched member of FIG. 2 of the first embodiment, that of FIG. 11 is different from the corresponding punched members above described, in that it comprises a different locking system for the superimposed cover and containing parts.

Also in this case it should be remarked beforehand that in said punched members components similar to those already disclosed will be indicated with the same reference numerals previously adopted.

Therefore, considering only the punched member of FIG. 11, it can be noted that the difference with respect to the previous corresponding ones resides in the formation of four rectangular wings 15 obtained by means of cuts in the bottom wall panel 3, of which two with the respective bases integral with the edge of the panel 4 along the crease connecting it to panel 3, each of said wings 15 being located in a position equally spaced from the respective adjacent arch shaped cuts 6 in the panel 3.

With the cover and containing parts of the packaging assembled in a three-dimensional form, as shown in FIGS. 13 and 14, respectively, the wings 15 are placed in an upright position in such a manner that in the superimposition of the covering on the containing part, as shown in FIG. 15, said wings on the former plabe themselves in contact with the corresponding portions of the external faces of the respective lateral wall panels 2' and 4' of the latter, to which they are then fastened, for instance by glueing, to obtain in this way the connection of said two parts of the packaging.

It should be kept in mind that the fastening of only one pair wings 15 on the panel 2' or 4' causes the creation of a hinge between said cover and containing parts, the locking of which in the superimposed position could take place at a later time by means of the fastening of the other pair of wings 15.

If it is considered advisable, on the opposite side of the panel 1 and/or 1' to that connected to panel 2, a grasping wing can be integrally formed, protruding towards the exterior, having the purpose of rendering more easy the separation of said cover and containing parts superimposed and fastened to one another.

According to a modification of the present invention, the removal of the arch shaped strips included between the respective pairs of said arch shaped external and internal portions of the symmetrically opposed cuts is omitted, and the portions of the panel 3, substantially corresponding to said arch shaped strips, are adapted for forming two opposed wings which can each be bent over elastically, along a respective crease connecting them to the punched member in question, towards the interior of the relative box shaped body obtained following the assembly in a three-dimensional form, of said punched member.

Said wings, besides stiffening the strip portions between adjacent apertures of respective half-housings of the same longitudinal row, allow adaption to eggs of different sizes in each of said half-housings, avoiding an undesirable play between the opening and the egg lying therein, and also preventing the eggs in adjacent half-housings from coming into contact with each other.

It is finally remarked that, even if in all the formerly described embodiments of the packaging for eggs of the present invention two distinct and separated punched members are provided for the covering part and the containing part, respectively, it is possible to have a single punched member for obtaining both the above-mentioned parts, comprising said two punched members integrally united to one onother by means of a longitudinal or transversal hinge edge, stating, moreover, that the elements that constitute the above described punched members may assume shapes different from the ones described.

The present invention is not limited to the disclosed embodiments, but includes any change or modification thereof.

I claim:

1. In a protective packaging for eggs comprising a superimposable, interchangeable containing part and a covering part each of which comprises and upper wall, a bottom wall and two opposed lateral walls, each of said parts including at least one row of complementary and longitudinally aligned half-housings, each half-housing being formed by a circular aperture in said upper wall of said containing part and in said bottom wall of said covering part, and by a support member for each egg, the improvement wherein each support member is formed by a first portion of said upper wall of said containing part and of the bottom wall of said covering part, wherein there is a cut out from said walls to form the circular apertures, and by a second portion integral with said first portions of corresponding lateral walls, said support members are folded towards interior portions of said containing and covering parts along preset folding lines.

2. A protective packaging for eggs according to claim 1 wherein said containing part and said covering part are obtained from single-piece flat punched members of cardboard comprising a first panel which constitutes a bottom wall of said containing part and an upper wall of said covering part, a side of which first panel is united by means of a crease to a side of a second panel forming a first lateral wall, the opposite side of which lateral wall is united by means of a crease to a side of a third panel, that constitutes the upper wall of said containing part and the bottom wall of said covering part, the opposite side of said third panel is united by means of a crease to a side of a fourth panel forming a second lateral wall, the opposite side of said second lateral wall is united by means of a crease to a fastening edge, wherein, for the formation of each of half-housings for eggs, two symmetrically opposed cuts which do not merge with each other are provided in said punched members, each of said cuts comprising a first portion in said third panel having the shape of an arch, and end of which is joined to a second portion extending transversally into one of said second and fourth panels, wherein corresponding ends of said two symmetrically opposed cuts are connected by a first and a second crease and a third crease parallel to the first two creases joins connection points of said first portion to said second portions of said symmetrically opposed cuts; said containing and covering parts being assemblable into a three-dimensional form following folding of said panels along said connection creases until said first panel is brought into a parallel relationship with respect to said third panel and an external face of said edge is brought into contact with a corresponding free edge portion of said first panel on which it is fastened, wherein said complementary half-housings for eggs are obtained, following assembly, by toggling with a spring action, and folding over along said first, second and third creases, the portions of said third panel, second and fourth panel included between said symmetrically opposed cuts to form said circular apertures and said support members.

3. A protective packaging for eggs according to claim 1, wherein siad fastening means of said containing and covering parts in a superimposed condition are by dots of glue on said panels of the upper wall of said containing part and on the bottom wall of said covering part.

4. A protective packaging for eggs according to claim 1, wherein said punched member of said covering part, tags are formed by means of cuts and shaped like the point of an arrow, and rectangular wings are formed in said punched member of said containing part in a position corresponding to said tags to create fastening means on said containing and covering parts in superimposed condition and united by said tags in corresponding holes obtained by a folding towards the interior of said wings, to exert on said tags, and elastic pressure suitable to prevent exit.

5. A protective packaging for eggs according to claim 1, wherein in said punched member of said covering part, wings are formed by means of cuts, said wings constituting fastening means of said containing and covering parts in the superimposed condition, and connected to each other by fastening said wings over the corresponding lateral wall panels of said containing part.

6. A protective packaging for eggs according to claim 1, further comprising a grasping wing laterally protruding form said bottom wall of said containing part and from said upper wall of said cover wall to render easier the separation of said cover and containing parts superimposed and fastened to each other.

7. A protective packaging for eggs according to claim 1, wherein each of said punched members of said containing part and of said covering part, in a portion of said panel adjacent to each of said first arch shaped portions of symmetrically opposed cuts, a formed wing is disposed which is elastically foldable towards the interior of said containing and covering parts assembled in a three-dimensional form.

* * * * *